United States Patent [19]

Tomita et al.

[11] Patent Number: 5,062,905

[45] **Date of Patent: * Nov. 5, 1991**

[54] METHOD OF PRODUCING NON-ORIENTED MAGNETIC STEEL PLATE HAVING HIGH MAGNETIC FLUX DENSITY

[75] Inventors: Yukio Tomita; Ryota Yamaba; Tatsuya Kumagai, all of Tokai, Japan

[73] Assignee: Nippon Steel Corporation, Tokyo, Japan; a

[ * ] Notice: The portion of the term of this patent subsequent to Aug. 21, 2007 has been disclaimed.

[21] Appl. No.: 567,142

[22] Filed: Aug. 14, 1990

[30] Foreign Application Priority Data

Aug. 18, 1989 [JP] Japan ..... 1-212689
Aug. 18, 1989 [JP] Japan ..... 1-212690

[51] Int. Cl.[5] ..... H01F 1/047

[52] U.S. Cl. ..... 148/111; 148/112; 148/113

[58] Field of Search ..... 148/111, 112, 113, 120, 148/121, 122, 307, 308, 309

[56] References Cited

U.S. PATENT DOCUMENTS 4,950,336 8/1990 Tomita et al. ..... 148/111

*Primary Examiner*—R. Dean
*Assistant Examiner*—Sikyin Ip
*Attorney, Agent, or Firm*—Kenyon & Kenyon

[57] ABSTRACT

A method of producing non-oriented magnetic steel plate having high magnetic flux density in a low magnetic field and uniform magnetic properties through the thickness direction, comprising selection of a heating temperature and finish rolling temperature to coarsen the size of the austenite grains and prevent refinement of the grain size in the rolling process, and annealing the steel after it has been rolled.

10 Claims, 3 Drawing Sheets

METHOD OF PRODUCING NON-ORIENTED MAGNETIC STEEL PLATE HAVING HIGH MAGNETIC FLUX DENSITY

BACKGROUND OF THE INVENTION

1. Field of the Invention

The present invention relates to a method of producing non-oriented magnetic steel plate having high magnetic flux density.

2. Description of the Prior Art

With the progress in recent years of elementary particle research and medical instruments, there is a need to improve the performance of devices utilizing magnets which are being used in large structures. There is also a need for materials which exhibit a high magnetic flux density in a low magnetic field to use as magnets in direct current applications and as shielding against magnetic fields. The further increase in the size of structures has also brought a demand for steel in which the magnetic properties have a low variation, and especially for steel plate having uniform magnetic properties through the thickness direction.

Numerous electrical steel sheets having good magnetic flux density have been provided, especially silicon steel sheet and electrical mild steel sheet. However, with respect to their use as structural members, problems with the assembly fabrication and strength of such materials has made it necessary to use heavy steel plate. Among the electrical heavy steel plate which has been produced so far is that using pure iron components, as in JP-A No. 60(1985)-96749.

However, the increasing size and performance of the devices concerned has brought with it a strong demand for steel materials with better magnetic properties, especially a high magnetic flux density in a low magnetic field of, for instance, 80 A/m. With the known steel materials it is not possible to obtain stably a high magnetic flux density in a low magnetic field of 80 A/m. In addition, the practical problem of variation in the magnetic properties of the steel is not addressed, particularly with respect to the uniformity of the magnetic properties through the thickness of the steel.

In Ser. Nos. 07/368.031 and 07/492.924 the present inventors proposed a method of producing nonoriented magnetic heavy steel plate having a high magnetic flux density.

SUMMARY OF THE INVENTION

An object of the present invention is to provide a method of producing non-oriented magnetic heavy steel plate having a high magnetic flux density in a low magnetic field and uniform magnetic properties through the thickness direction.

BRIEF DESCRIPTION OF THE DRAWINGS

The objects and features of the present invention will become more apparent from a consideration of the following detailed description taken in conjunction with the accompanying drawings in which.

DETAILED DESCRIPTION OF THE INVENTION

The process of magnetization to raise the magnetic flux density in a low magnetic field consists of placing degaussed steel in a magnetic field and changing the orientation of the magnetic domains by increasing the intensity of the magnetic field so that domains oriented substantially in the direction of the magnetic field become preponderant, encroaching on, and amalgamating with, other domains. That is to say, the domain walls are moved. When the magnetic field is further intensified and the moving of the domain walls is completed, the magnetic orientation of all the domains is changed. In this magnetization process, the ease with which the domain walls can be moved decides the magnetic flux density in a low magnetic field. That is, it can be stated that to obtain a high magnetic flux density in a low magnetic field requires that obstacles to the movement of the domain walls must be minimized.

As means of obtaining a high magnetic flux density in a low magnetic field, the inventors carried out detailed investigations relating to crystal grain size, the effects of elements that cause internal stresses and cavity defects.

As a result, it was found that an effective method of carrying out the production of the steel was to select a heating temperature and finish rolling temperature to coarsen the size of the austenite grains and prevent the crystal grain size being refined by the rolling process, and to carry out annealing following the rolling.

Figure 1:
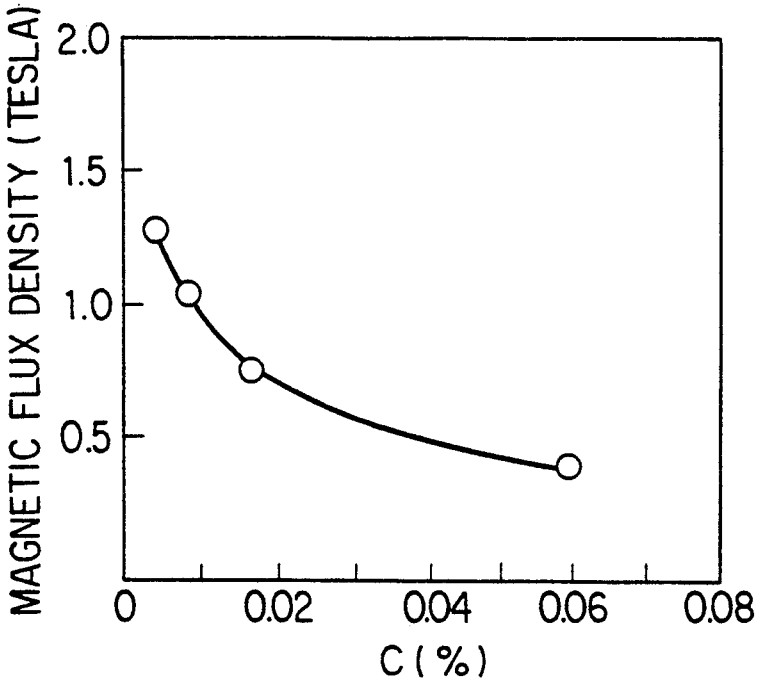
FIG. 1 is a graph showing the relationship between carbon content and magnetic flux density at 80 A/m.

Also, carbon has to be reduced to reduce internal stresses. FIG. 1 shows that as the carbon content is increased, there is a decrease in the magnetic flux density in a low magnetic field of 80 A/m. For the samples, (1.0 Si - 0.1 Mn - 2.0 Al) steel was used.

With respect to the effect of cavity defects, it was found that there was a large degradation in the magnetic properties when cavity defects measured 100 micrometers or more. It was also found that a rolling shape factor A of 0.6 or more is required to eliminate such harmful cavity defects measuring 100 micrometers or more.

This is provided that:

$$A = (2\sqrt{R(h_i - h_o)})/(h_i + h_o)$$

where

A: rolling shape factor $h_i$: entry-side plate thickness (mm)

$h_o$: exit-side plate thickness (mm)

R: radius (mm) of rolling roll.

Figure 2:
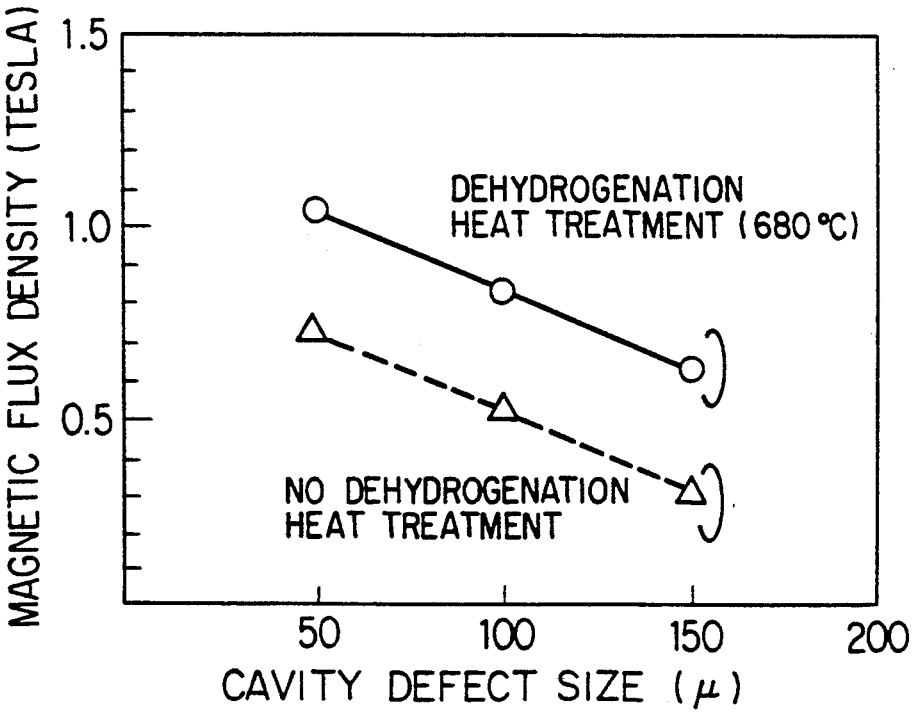
FIG. 2 is a graph showing the relationship between cavity defect size and dehydrogenation heat treatment temperature on magnetic flux density at 80 A/m.

As shown by FIG. 2, the presence of hydrogen in the steel is deleterious, and it was discovered that the magnetic properties could be improved greatly by the use of dehydrogenation heat treatment. FIG. 2 shows that by using high shape facto rolling to reduce the size of cavity defects to less than 100 micrometers and reducing the hydrogen content in the steel by dehydrogenation heat treatment, magnetic flux density in a low magnetic field could be markedly raised. For the samples, (0.007 C - 1.5 Si - 0.1 Mn) steel was used.

Furthermore, it was confirmed that this method according to the invention is also a highly effective means of ensuring uniformity of the magnetic properties.

Figure 3:
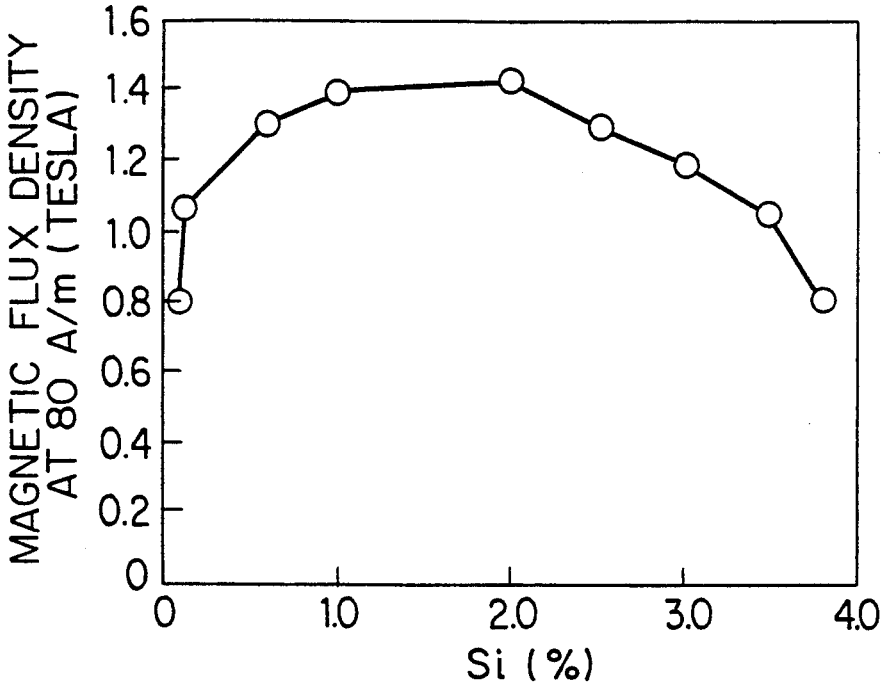
FIG. 3 is a graph showing the relationship between silicon content and magnetic flux density at 80 A/m.
Figure 4:
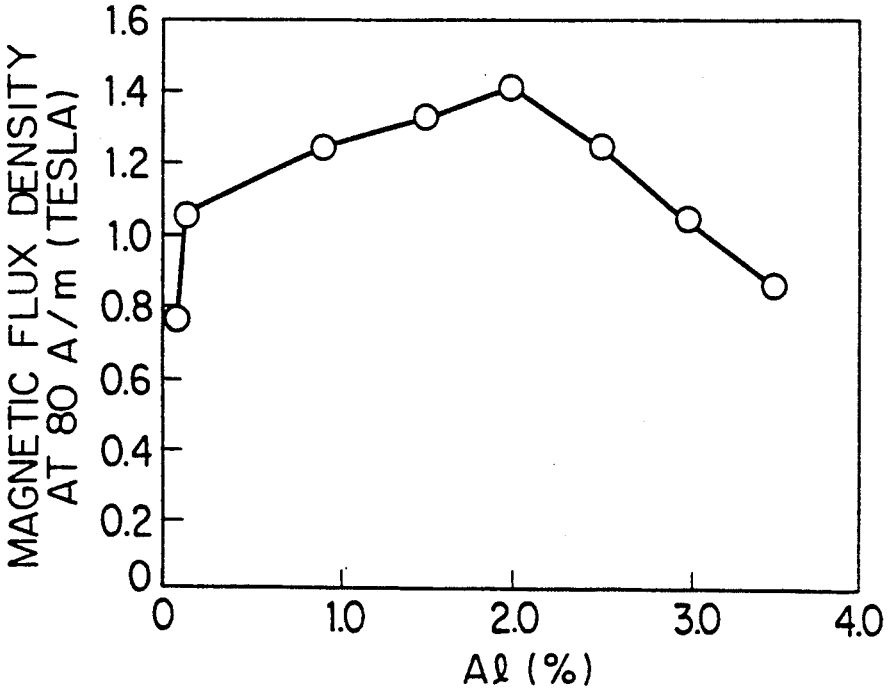
FIG. 4 is a graph showing the relationship between aluminum content and magnetic flux density at 80 A/m.

With respect to the component elements, adding silicon and aluminum was found to be highly effective for obtaining a high magnetic flux density in a low magnetic field. FIGS. 3 and 4 indicate the relationship between silicon and aluminum content and magnetic flux density in a low magnetic field (80 A/m), in the case of (0.005 C - 0.08 Mn) steel.

In this invention, a high magnetic flux density was obtained with a silicon content in the range 0.1–3.5 percent, particularly in the range 0.6–2.5 percent, and an aluminum content in the range 0.1–3.0 percent, particularly in the range 0.9–2.5 percent.

The precipitation of fine grains of AlN hinders the movement of domain walls, but this hindrance to the movement of the domain walls can be eliminated by adding larger amounts of aluminum to coarsen the size of the crystal grains. In addition, as the use of larger amounts of added aluminum elevates the transformation point, it enhances the coarsening effect of the heat treatment following rolling. These two mechanisms produce an increase in magnetic flux density in a low magnetic field.

Thus, the present invention comprises the steps of:

preparing a steel slab comprising, by weight, up to 0.01 percent carbon, 0.10 to 3.5 percent silicon, up to 0.20 percent manganese, up to 0.010 percent sulfur, up to 0.05 percent chromium, up to 0.01 percent molybdenum, up to 0.01 percent copper, 0.10 to 3.0 percent aluminum, up to 0.004 percent nitrogen, up to 0.005 percent oxygen and up to 0.0002 percent hydrogen, with the remainder being substantially iron;

heating the slab to a temperature of 950° to 1300° C.;

hot-rolling the slab at least once at a rolling shape factor A of at least 0.6 at a finish rolling temperature of at least 800° C.;

dehydrogenation heat treatment at between 600 and 750° C. for steel plate with a plate thickness of 50 mm or more;

annealing at a temperature of 700° to 950° C., if required;

annealing at a temperature of 750° to 950° C. for hot-rolled steel plate with a plate thickness that is less than 50 mm;

whereby a magnetic flux density of 0.8 tesla or more at a magnetic field of 80 A/m is imparted to the steel.

The hot rolling is accomplished using a rolling mill having a radius R (mm) and wherein the steel plate has an entry-side thickness $h_i$ (mm) and an exit-side plate thickness $h_o$ (mm) which exhibits a relationship with rolling shape factor A of the hot rolling as follows:

$$A = (2\sqrt{R(h_i - h_o)})/(h_i + h_o).$$

Process A according to the present invention will now be described, starting with an explanation of the reasons for the component limitations.

Carbon increases internal stresses in steel and is the element most responsible for degradation of magnetic properties, especially magnetic flux density in a low magnetic field, and as such, minimizing the carbon content helps to prevent a drop in the magnetic flux density in a low magnetic field. Also, lowering the carbon content decreases the magnetic aging of the steel, and thereby extends the length of time the steel retains its good magnetic properties. Hence, carbon is limited to a maximum of 0.010 percent. As shown in FIG. 1, an even higher magnetic flux density can be obtained by reducing the carbon content to 0.005 percent or less.

Silicon and aluminum are effective for achieving high magnetic flux density in a low magnetic field. With reference to FIG. 3, therefore, 0.1 to 3.5 percent silicon is specified, more preferably 0.6 to 2.5 percent. With reference to FIG. 4, 0.1 to 3.0 percent aluminum is specified, more preferably 0.9 to 2.5 percent.

Low manganese is desirable for achieving high magnetic flux density in a low magnetic field and for reducing MnS inclusions. Therefore up to 0.20 percent is specified as the limit for manganese. To reduce MnS inclusions, a manganese content of no more than 0.10 percent is preferable.

Sulfur and oxygen produce non-metallic inclusions in the steel and, through segregation, obstruct the movement of magnetic domain walls. The higher the content amounts of these elements, the more pronounced the deterioration in the magnetic flux density, therefore an upper limit of 0.010 percent has been specified for sulfur and 0.005 percent for oxygen.

Chromium, molybdenum and copper each have an adverse effect on magnetic flux density in a low magnetic field, so the content amounts of these elements should be kept as low as possible. A further reason for minimizing these elements is to reduce the degree of segregation. Accordingly, an upper limit of 0.05 percent has been specified for chromium, 0.01 percent for molybdenum and 0.01 percent for copper.

Nitrogen increases internal stresses in the steel and in the form of AlN has the effect of refining the size of the grains, thereby causing a deterioration in magnetic flux density in a low magnetic field. Therefore, an upper limit of 0.004 percent has been specified.

To prevent hydrogen having an adverse effect on the magnetic properties and preventing reductions in cavity defects, an upper limit of 0.0002 percent hydrogen has been specified.

The method for producing the steel will now be described. The steel is heated to a temperature of at least 1150° C. prior to rolling in order to coarsen the size of the austenite grains and improve the magnetic properties. An upper limit of 1300° C. is specified to prevent scaling loss and to conserve on energy.

If the finish rolling temperature is below 900° C., the rolling will refine the size of the crystal grains, adversely affecting the magnetic properties. As such, a temperature of 900° C. or more is specified with the aim of achieving an increase in the magnetic flux density as a result of a coarsening of the size of the crystal grains.

Regarding the hot rolling, the solidification process will always give rise to cavity defects, although the size of the defects may vary. Rolling has to be used to eliminate such cavity defects, so hot rolling has an important role. An effective means is to increase the amount of deformation per hot rolling, so that the deformation extends to the core of the steel plate.

Employing high shape factor rolling which includes at least one pass at a rolling shape factor A of at least 0.6 so that the size of cavity defects is no larger than 100 micrometers is conducive to obtaining desirable magnetic properties. Eliminating cavity defects in the rolling process by using this high shape factor rolling markedly enhances dehydrogenation efficiency in the subsequent dehydrogenation heat treatment.

Continuing on from the hot rolling, dehydrogenation heat treatment is employed on heavy plate with a plate thickness of 50 mm or more to coarsen the grain size and remove internal stresses. Hydrogen does not readily disperse in heavy plate having a thickness of 50 mm or more, which causes cavity defects and, in unison with the effect of the hydrogen itself, degrades magnetic flux density in a low magnetic field.

This is why dehydrogenation heat treatment is used. However, if the temperature of the dehydrogenation heat treatment is below 600.C. the dehydrogenation efficiency is lowered, while if the temperature exceeds 750° C. there is a partial onset of transformation. Hence, a temperature range of 600° to 750° C. is specified. Various studies relating to dehydrogenation time show a time of $[0.6(t-50)+6]$ hours (t being plate thickness) to be suitable.

The steel is annealed to coarsen the grain size and remove internal stresses. Annealing at a temperature below 750° C. will not produce this coarsening of the crystal grains, while uniformity of the crystal grains through the thickness direction of the plate cannot be maintained if the temperature exceeds 950° C. Therefore an annealing temperature range of 750° C. to 950° C. has been specified.

Normalizing is done to adjust the crystal grains in the thickness direction of the plate and to remove internal stresses. However, below 910° C., that is, an $Ac_3$ point temperature, or over 1000° C., uniformity of the crystal grains in the thickness dimension of the plate cannot be maintained, so a range of 910° to 1000° C. has been specified for the normalizing temperature. The dehydrogenation heat treatment employed for heavy plates having a plate thickness of 50 mm or more can also be used for the annealing or normalizing.

Process B according to the present invention will next be described. The constituent components of the steel of Process B are the same as those of Process A. With reference to Process B, heating the plate at a relatively low temperature oriented the reheated $\tau$ grains through the thickness direction, and the addition of light rolling at 800° C. promoted grain growth. The result wa that slightly coarse grains were obtained with a uniform size through the thickness direction. The crystalline texture introduced by the light rolling at or below 800° C. orients the domains and facilitates the movement of domain walls, improving the magnetic properties.

Figure 5:
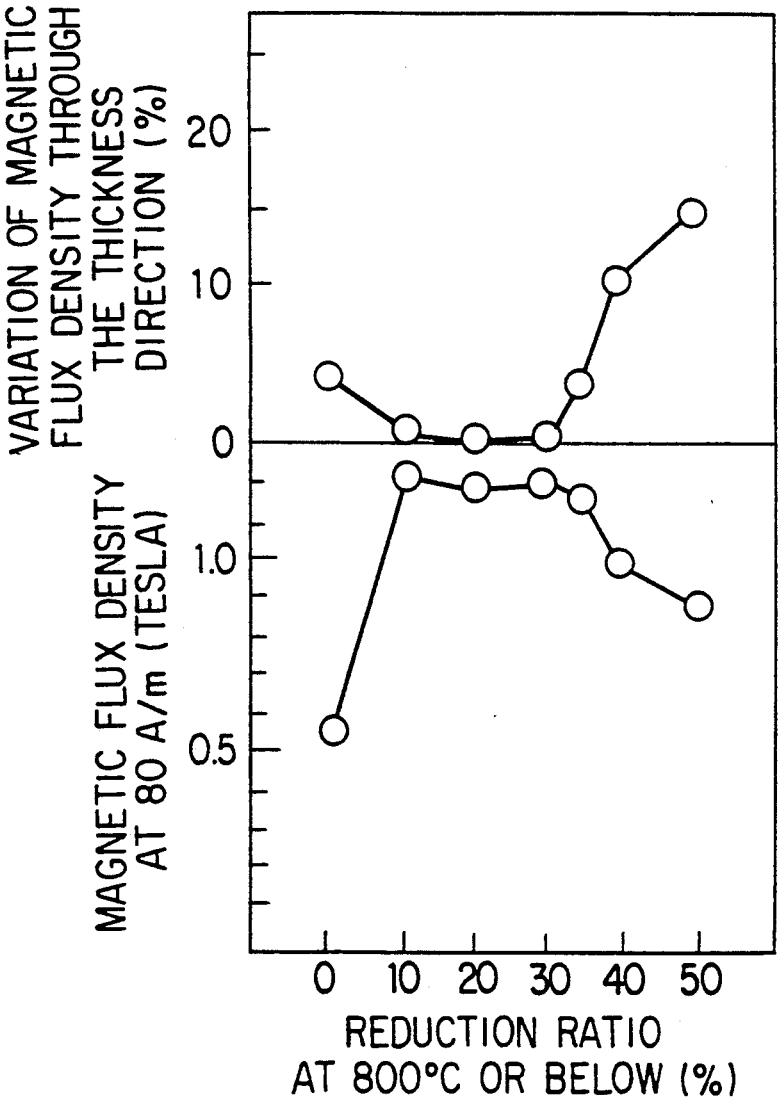
FIG. 5 is a graph showing the relationship between the reduction ratio at 800° C. or below and, respectively, magnetic flux density at 80 A/m, and variation of magnetic flux density through the thickness direction.

FIG. 5 shows the relationship between the reduction ratio at up to 800° C. and, respectively, magnetic flux density at 80 A/m, and variation of magnetic flux density through the thickness direction in (1.5 Si - 0.06 Mn - 1.2 Al) steel. A reduction ratio of 10 to 35 percent provides a high magnetic flux density that is uniform through the thickness direction.

With respect to the effect of cavity defects, it was found that there was a large degradation in the magnetic properties when cavity defects measured 100 micrometers or more. It was also found that a rolling shape factor A of 0.6 or more is required to eliminate such harmful cavity defects measuring 100 micrometers or more.

The steel is heated to a temperature of up to 1150° C. prior to rolling. Exceeding this temperature will cause a large variation in the size of the reheated grains through the thickness direction which will remain after completion of the rolling, producing non-uniformity of the grains. A heating temperature that is less than 950° C. will increase the resistance to rolling deformation and the rolling load used to achieve a high rolling shape factor for eliminating cavity defects, as described below, hence the lower limit of 950° C.

Regarding the hot rolling, the solidification process will always gives rise to cavity defects, although the size of the defects may vary. Rolling has to be used to eliminate such cavity defects, so hot rolling has an important role. An effective means is to increase the amount of deformation per hot rolling at 800° C. or above so that the deformation extends to the core of the steel plate. Specifically, using high shape factor rolling which includes at least one pass at a rolling shape factor A or at least 0.6 so that the size of cavity defects is no larger than 100 micrometers is conductive to obtaining desirable magnetic properties. Eliminating cavity defects in the rolling process by using this high shape factor rolling markedly enhances dehydrogenation efficiency in the subsequent dehydrogenation heat treatment. The reason for using high shape factor rolling at a heating temperature of at least 800° C. is that a temperature below 800° C. will increase the resistance of the steel to rolling deformation and the load on the rolling mill.

Following this by light rolling at a temperature of up to 800° C. is conductive to achieving uniform grain growth through the thickness direction, and the resulting crystalline texture produces an alignment of the domains which facilitates the movement of the domain walls in a low magnetic field and improves the uniformity of the magnetic properties through the thickness direction.

As shown in FIG. 5, a reduction ratio of at least 10 percent up to 800° C. is required to achieve an increase in the magnetic flux density in a low magnetic field, hence a lower limit of 10 percent is specified. A reduction ratio of 35 percent up to 800° C. is specified as the upper limit since a reduction ratio over 35 percent will cause a large increase in the variation of the magnetic properties through the thickness direction.

After the hot rolling, dehydrogenation heat treatment is employed on steel plate with a plate thickness of 50 mm or more to coarsen the grain size and remove internal stresses. Dehydrogenation heat treatment and normalizing, if required, are based on the procedures set out for Process A.

As hydrogen readily disperses in steel plate that is less than 50 mm thick, such plate only requires annealing or normalizing, not dehydrogenation heat treatment. These procedures are based on the procedures set out for Process A.

As described above, in accordance with this invention defined component limits are used to impart uniform, high magnetic properties to heavy steel plate, enabling it to be applied to structures utilizing magnetic properties produced using DC magnetization. Moreover, the production method uses component limits together with the adjustment of grain size after hot rolling and dehydrogenation heat treatment, making it a highly economical production method.

EXAMPLE 1

Table 1 lists the production conditions, ferrite grain size and magnetic flux density in a low magnetic field. Steels 1 to 10 are inventive steels and steels 11 to 30 are comparative steels.

Steels 1 to 5, which were finished to a thickness of 100 mm and had coarse, uniform grains, exhibited good magnetic properties. Compared with steel 1, steel 2, with lower carbon, steels 3 and 4, with lower manganese, and steel 5, with lower aluminum, showed better magnetic properties. Steels 6 to 8, which were finished to a thickness of 500 mm, steel 9, which was finished to a thickness of 40 mm, and steel 10, which was finished to a thickness of 20 mm, each had coarse, uniform grains and exhibited good magnetic properties.

As a result of the upper limit being exceeded for carbon in steel 11, the lower limit for silicon in steel 12, the upper limit for silicon in steel 13, for manganese in steel 14, for sulfur in steel 15, for chromium in steel 16, for molybdenum in steel 17 and for copper in steel 18, the lower limit for aluminum in steel 19 and the higher limit for aluminum in steel 20, nitrogen in steel 21, oxygen in steel 22 and hydrogen in steel 23, each of these steels had poorer magnetic properties. Poorer magnetic properties were also shown by steel 24 because the heating temperature used was too low, by steel b 25 because the rolling finishing temperature was too low, by steel 26 because the maximum rolling shape factor was too low, by steel 27 because the dehydrogenation temperature was too low, by steel 28 because the annealing temperature was too low, by steel 29 because the normalizing temperature was too high and by steel 30 because it was not subjected to dehydrogenation heat treatment.

TABLE 1

| | | Chemical composition (wt %) | | | | | | | | | | | |
|---|---|---|---|---|---|---|---|---|---|---|---|---|---|
| | No. | C | Si | Mn | P | S | Cr | Mo | Cu | Al | N | O | H |
| Present Invention | 1 | 0.007 | 1.0 | 0.15 | 0.010 | 0.003 | 0.04 | 0.007 | 0.01 | 2.0 | 0.003 | 0.004 | 0.00007 |
| " | 2 | 0.003 | 1.0 | 0.14 | 0.011 | 0.003 | 0.03 | 0.008 | 0.01 | 2.0 | 0.003 | 0.003 | 0.00007 |
| " | 3 | 0.007 | 1.5 | 0.08 | 0.009 | 0.003 | 0.03 | 0.010 | 0.01 | 1.5 | 0.003 | 0.003 | 0.00007 |
| " | 4 | 0.006 | 1.5 | 0.01 | 0.012 | 0.002 | 0.04 | 0.008 | 0.01 | 1.5 | 0.003 | 0.003 | 0.00007 |
| " | 5 | 0.007 | 2.0 | 0.15 | 0.008 | 0.008 | 0.03 | 0.009 | 0.01 | 1.0 | 0.002 | 0.004 | 0.00006 |
| " | 6 | 0.008 | 2.0 | 0.14 | 0.005 | 0.008 | 0.04 | 0.007 | 0.01 | 1.0 | 0.002 | 0.004 | 0.00006 |
| " | 7 | 0.008 | 3.0 | 0.14 | 0.005 | 0.008 | 0.04 | 0.007 | 0.01 | 0.6 | 0.002 | 0.004 | 0.00006 |
| " | 8 | 0.008 | 3.1 | 0.14 | 0.005 | 0.004 | 0.04 | 0.007 | 0.01 | 0.6 | 0.002 | 0.004 | 0.00006 |
| " | 9 | 0.006 | 0.6 | 0.17 | 0.007 | 0.003 | 0.02 | 0.009 | 0.01 | 2.5 | 0.003 | 0.003 | 0.00008 |
| " | 10 | 0.007 | 0.6 | 0.15 | 0.009 | 0.005 | 0.04 | 0.008 | 0.01 | 2.5 | 0.003 | 0.002 | 0.00011 |
| Comparative | 11 | 0.020 | 1.0 | 0.16 | 0.012 | 0.004 | 0.05 | 0.009 | 0.01 | 1.4 | 0.003 | 0.003 | 0.00008 |
| " | 12 | 0.006 | 0.05 | 0.14 | 0.010 | 0.003 | 0.03 | 0.006 | 0.01 | 1.4 | 0.003 | 0.002 | 0.00007 |
| " | 13 | 0.005 | 4.0 | 0.13 | 0.009 | 0.002 | 0.03 | 0.005 | 0.01 | 1.5 | 0.003 | 0.002 | 0.00008 |
| " | 14 | 0.007 | 1.6 | 0.30 | 0.012 | 0.002 | 0.04 | 0.008 | 0.01 | 0.8 | 0.002 | 0.002 | 0.00006 |
| " | 15 | 0.006 | 1.6 | 0.14 | 0.010 | 0.015 | 0.03 | 0.006 | 0.01 | 0.8 | 0.002 | 0.003 | 0.00015 |
| " | 16 | 0.007 | 1.6 | 0.15 | 0.010 | 0.003 | 0.10 | 0.005 | 0.01 | 0.9 | 0.002 | 0.002 | 0.00008 |
| " | 17 | 0.006 | 0.4 | 0.13 | 0.012 | 0.003 | 0.04 | 0.050 | 0.01 | 2.8 | 0.003 | 0.002 | 0.00007 |
| " | 18 | 0.007 | 0.4 | 0.13 | 0.013 | 0.002 | 0.04 | 0.007 | 0.03 | 2.8 | 0.003 | 0.002 | 0.00006 |
| " | 19 | 0.006 | 0.4 | 0.12 | 0.011 | 0.002 | 0.04 | 0.005 | 0.01 | 0.05 | 0.003 | 0.002 | 0.00007 |
| " | 20 | 0.009 | 2.8 | 0.15 | 0.013 | 0.003 | 0.04 | 0.006 | 0.01 | 3.5 | 0.003 | 0.003 | 0.00005 |
| " | 21 | 0.008 | 2.8 | 0.16 | 0.014 | 0.002 | 0.03 | 0.005 | 0.01 | 0.4 | 0.006 | 0.003 | 0.00004 |
| " | 22 | 0.008 | 2.8 | 0.13 | 0.015 | 0.006 | 0.02 | 0.009 | 0.01 | 0.4 | 0.002 | 0.010 | 0.00005 |
| " | 23 | 0.007 | 2.3 | 0.12 | 0.014 | 0.006 | 0.02 | 0.009 | 0.01 | 0.9 | 0.002 | 0.003 | 0.00030 |
| " | 24 | 0.008 | 2.3 | 0.16 | 0.010 | 0.002 | 0.02 | 0.008 | 0.01 | 0.9 | 0.002 | 0.002 | 0.00008 |
| " | 25 | 0.007 | 2.3 | 0.16 | 0.008 | 0.002 | 0.04 | 0.008 | 0.01 | 0.9 | 0.003 | 0.002 | 0.00007 |
| " | 26 | 0.006 | 1.2 | 0.17 | 0.002 | 0.008 | 0.04 | 0.007 | 0.01 | 2.0 | 0.003 | 0.003 | 0.00006 |
| " | 27 | 0.009 | 1.2 | 0.16 | 0.001 | 0.008 | 0.04 | 0.006 | 0.01 | 2.0 | 0.003 | 0.003 | 0.00005 |
| " | 28 | 0.007 | 1.2 | 0.16 | 0.012 | 0.002 | 0.03 | 0.005 | 0.01 | 2.0 | 0.002 | 0.002 | 0.00004 |
| " | 29 | 0.008 | 1.2 | 0.17 | 0.012 | 0.002 | 0.03 | 0.004 | 0.01 | 2.0 | 0.003 | 0.002 | 0.00018 |
| " | 30 | 0.008 | 1.2 | 0.15 | 0.013 | 0.002 | 0.03 | 0.005 | 0.01 | 2.4 | 0.002 | 0.003 | 0.00008 |

| | No. | Heating Temp. (°C.) | Finishing Rolling Temp. (°C.) | Maximum Rolling Shape Factor | Dehydrogenate Heat treating Temp. (°C.) | Annealing Temp. (°C.) | Normalizing Temp. (°C.) |
|---|---|---|---|---|---|---|---|
| Present Invention | 1 | 1250 | 940 | 0.9 | 700 | — | — |
| " | 2 | 1250 | 940 | 0.9 | 700 | — | — |
| " | 3 | 1250 | 940 | 0.9 | 700 | — | — |
| " | 4 | 1250 | 940 | 0.9 | 700 | — | — |
| " | 5 | 1150 | 940 | 0.9 | 700 | — | — |
| " | 6 | 1250 | 980 | 0.8 | 720 | — | — |
| " | 7 | 1250 | 980 | 0.8 | 720 | 850 | — |
| " | 8 | 1250 | 980 | 0.8 | 720 | — | 930 |
| " | 9 | 1250 | 920 | 1.1 | — | 850 | — |
| " | 10 | 1250 | 910 | 1.2 | — | — | 930 |
| Comparative | 11 | 1250 | 930 | 0.85 | 680 | — | — |
| " | 12 | 1250 | 930 | 0.85 | 680 | — | — |
| " | 13 | 1250 | 930 | 0.85 | 680 | — | — |
| " | 14 | 1250 | 930 | 0.85 | 680 | — | — |
| " | 15 | 1250 | 930 | 0.85 | 680 | — | — |
| " | 16 | 1250 | 930 | 0.85 | 680 | — | — |
| " | 17 | 1250 | 930 | 0.85 | 680 | — | — |
| " | 18 | 1250 | 930 | 0.85 | 680 | — | — |
| " | 19 | 1250 | 930 | 0.85 | 680 | — | — |
| " | 20 | 1250 | 930 | 0.85 | 680 | — | — |
| " | 21 | 1250 | 930 | 0.85 | 680 | — | — |
| " | 22 | 1250 | 930 | 0.85 | 680 | — | — |
| " | 23 | 1250 | 930 | 0.85 | 680 | — | — |
| " | 24 | 1050 | 930 | 0.85 | 680 | — | — |
| " | 25 | 1200 | 850 | 0.85 | 680 | — | — |
| " | 26 | 1200 | 930 | 0.50 | 680 | — | — |

TABLE 1-continued

| | | | | | | | |
|---|---|---|---|---|---|---|---|
| " | 27 | 1200 | 920 | 0.9 | 550 | — | — |
| " | 28 | 1200 | 920 | 1.1 | — | 700 | — |
| " | 29 | 1200 | 920 | 1.1 | — | — | 1050 |
| " | 30 | 1200 | 920 | 0.9 | — | 850 | — |

| | No. | Thickness (mm) | Cavity Defect Size (μ) | Ferrite Grain No. | Magnetic Flux Density at 80A/m (Tesla) |
|---|---|---|---|---|---|
| Present Invention | 1 | 100 | 20 | 0 | 1.25 |
| " | 2 | 100 | 25 | 0 | 1.55 |
| " | 3 | 100 | 25 | 0 | 1.48 |
| " | 4 | 100 | 20 | 0 | 1.54 |
| " | 5 | 100 | 25 | 0 | 1.45 |
| " | 6 | 500 | 90 | −1 | 1.25 |
| " | 7 | 500 | 90 | −1 | 1.30 |
| " | 8 | 500 | 90 | −1 | 1.27 |
| " | 9 | 40 | 10 | 0 | 1.35 |
| " | 10 | 10 | 5 | 0 | 1.30 |
| Comparative | 11 | 200 | 80 | 0 | 0.70 |
| " | 12 | 200 | 85 | 0 | 0.80 |
| " | 13 | 200 | 80 | 0 | 0.76 |
| " | 14 | 200 | 80 | 0 | 0.90 |
| " | 15 | 200 | 75 | 3 | 0.85 |
| " | 16 | 200 | 80 | 0 | 0.87 |
| " | 17 | 200 | 80 | 0 | 0.88 |
| " | 18 | 200 | 75 | 0 | 0.80 |
| " | 19 | 200 | 80 | 0 | 0.79 |
| " | 20 | 200 | 80 | 5 | 0.85 |
| " | 21 | 200 | 75 | 4 | 0.90 |
| " | 22 | 200 | 80 | 0 | 0.86 |
| " | 23 | 200 | 95 | 0 | 0.85 |
| " | 24 | 200 | 80 | 6 | 0.70 |
| " | 25 | 200 | 75 | 5 | 0.75 |
| " | 26 | 200 | 150 | 2 | 0.75 |
| " | 27 | 200 | 80 | 0 | 0.80 |
| " | 28 | 40 | 10 | 0 | 0.80 |
| " | 29 | 40 | 10 | 0 | 0.85 |
| " | 30 | 200 | 70 | 0 | 0.70 |

EXAMPLE 2

Table 2 lists the production conditions, ferrite grain size and magnetic flux density in a low magnetic field, and variation in magnetic flux density through the thickness direction. Steels 31 to 40 are inventive steels and steels 41 to 49 are comparative steels.

Steels 31 to 35 were finished to a thickness of 100 mm and exhibited high magnetic flux density with low variation through the thickness direction. Compared with steel 31, steel 32, with lower carbon, steels 33 and 34, with lower manganese, and steel 35, with lower aluminum, showed better magnetic properties. Steels 36 to 38, which were finished to a thickness of 500 mm, steel 39, which was finished to a thickness of 40 mm, and steel 40, which was finished to a thickness of 6 mm, each exhibited high magnetic flux density with low variation through the thickness direction. Because the heating temperature used was too high, steel 41 showed a large variation in magnetic flux density through the thickness direction. Steel 42 showed low magnetic flux density, also with a large variation through the thickness direction, owing to a rolling finishing temperature that was too low, producing a small maximum rolling shape factor. Steel 43 showed low magnetic flux density as a result of a reduction ratio at up to 800° C. that exceeded the lower limit, while steel 44 showed a large variation in magnetic flux density through the thickness direction as a result of a reduction ratio at up to 800° C. that exceeded the upper limit. A low magnetic flux density and large variation in magnetic flux density through the thickness direction was produced in steel 45 because the maximum rolling shape factor was too low, in steel 46 because the dehydrogenation temperature was too low, in steel 47 because the annealing temperature was too low, in steel 48 because the normalizing temperature was too high and in steel 49 because it was not subjected to dehydrogenation heat treatment.

TABLE 2

| | No. | Chemical composition (wt %) | | | | | | | | | | | |
|---|---|---|---|---|---|---|---|---|---|---|---|---|---|
| | | C | Si | Mn | P | S | Cr | Mo | Cu | Al | N | O | H |
| Present invention | 31 | 0.007 | 1.0 | 0.15 | 0.010 | 0.003 | 0.04 | 0.007 | 0.01 | 2.0 | 0.003 | 0.004 | 0.00007 |
| " | 32 | 0.003 | 1.0 | 0.14 | 0.011 | 0.003 | 0.03 | 0.008 | 0.01 | 2.1 | 0.003 | 0.003 | 0.00007 |
| " | 33 | 0.007 | 1.5 | 0.08 | 0.009 | 0.003 | 0.03 | 0.010 | 0.01 | 1.6 | 0.003 | 0.003 | 0.00007 |
| " | 34 | 0.006 | 1.5 | 0.01 | 0.012 | 0.002 | 0.04 | 0.008 | 0.01 | 1.6 | 0.003 | 0.003 | 0.00007 |
| " | 35 | 0.007 | 2.0 | 0.15 | 0.008 | 0.008 | 0.03 | 0.009 | 0.01 | 0.9 | 0.002 | 0.004 | 0.00006 |
| " | 36 | 0.008 | 2.0 | 0.14 | 0.005 | 0.008 | 0.04 | 0.007 | 0.01 | 0.9 | 0.002 | 0.004 | 0.00006 |
| " | 37 | 0.008 | 3.0 | 0.14 | 0.005 | 0.008 | 0.04 | 0.007 | 0.01 | 0.5 | 0.002 | 0.004 | 0.00006 |
| " | 38 | 0.008 | 3.0 | 0.14 | 0.005 | 0.004 | 0.04 | 0.007 | 0.01 | 0.5 | 0.002 | 0.004 | 0.00006 |
| " | 39 | 0.006 | 2.5 | 0.17 | 0.007 | 0.003 | 0.02 | 0.009 | 0.01 | 1.0 | 0.003 | 0.003 | 0.00008 |
| " | 40 | 0.007 | 0.5 | 0.15 | 0.009 | 0.005 | 0.04 | 0.008 | 0.01 | 1.0 | 0.003 | 0.002 | 0.00011 |
| " | 41 | 0.008 | 0.9 | 0.16 | 0.010 | 0.002 | 0.02 | 0.008 | 0.01 | 2.1 | 0.002 | 0.002 | 0.00008 |
| " | 42 | 0.008 | 0.9 | 0.15 | 0.011 | 0.003 | 0.02 | 0.009 | 0.01 | 2.1 | 0.002 | 0.002 | 0.00009 |
| " | 43 | 0.008 | 0.9 | 0.16 | 0.010 | 0.002 | 0.02 | 0.008 | 0.01 | 2.0 | 0.002 | 0.002 | 0.00007 |

TABLE 2-continued

| | | | | | | | | | | | | | |
|---|---|---|---|---|---|---|---|---|---|---|---|---|---|
| " | 44 | 0.007 | 0.9 | 0.14 | 0.011 | 0.003 | 0.03 | 0.009 | 0.01 | 2.0 | 0.002 | 0.002 | 0.00008 |
| " | 45 | 0.006 | 1.8 | 0.17 | 0.002 | 0.008 | 0.04 | 0.007 | 0.01 | 2.0 | 0.003 | 0.003 | 0.00006 |
| " | 46 | 0.009 | 1.8 | 0.16 | 0.001 | 0.008 | 0.04 | 0.006 | 0.01 | 1.3 | 0.003 | 0.003 | 0.00005 |
| " | 47 | 0.007 | 1.8 | 0.16 | 0.012 | 0.002 | 0.03 | 0.005 | 0.01 | 1.3 | 0.002 | 0.002 | 0.00004 |
| " | 48 | 0.008 | 2.1 | 0.17 | 0.012 | 0.002 | 0.03 | 0.004 | 0.01 | 1.3 | 0.003 | 0.002 | 0.00018 |
| " | 49 | 0.008 | 2.1 | 0.15 | 0.013 | 0.002 | 0.03 | 0.005 | 0.01 | 1.5 | 0.002 | 0.003 | 0.00008 |

| | No. | Heating Temp. (°C.) | Reduction at under 800° C. (%) | Finishing Rolling Temp. (°C.) | Maximum Rolling Shape Factor | Dehydrogenate Heat treating Temp. (°C.) | Annealing Temp. (°C.) | Normalizing Temp. (°C.) |
|---|---|---|---|---|---|---|---|---|
| Present Invention | 31 | 1050 | 20 | 700 | 0.80 | 700 | — | — |
| " | 32 | 1050 | 20 | 700 | 0.80 | 700 | — | — |
| " | 33 | 1050 | 20 | 700 | 0.80 | 700 | — | — |
| " | 34 | 1050 | 20 | 700 | 0.80 | 700 | — | — |
| " | 35 | 1050 | 20 | 700 | 0.80 | 700 | — | — |
| " | 36 | 1100 | 15 | 750 | 0.65 | 720 | — | — |
| " | 37 | 1100 | 15 | 750 | 0.65 | 720 | 850 | — |
| " | 38 | 1100 | 15 | 750 | 0.65 | 720 | — | 930 |
| " | 39 | 950 | 25 | 710 | 1.10 | — | 850 | — |
| " | 40 | 950 | 25 | 710 | 1.20 | — | — | 930 |
| Comparative | 41 | 1200 | 25 | 700 | 0.72 | 680 | — | — |
| " | 42 | 900 | 25 | 700 | 0.51 | 680 | — | — |
| " | 43 | 1050 | 0 | 710 | 0.72 | 680 | — | — |
| " | 44 | 1050 | 50 | 710 | 0.72 | 680 | — | — |
| " | 45 | 1050 | 25 | 710 | 0.50 | 680 | — | — |
| " | 46 | 1050 | 25 | 710 | 0.72 | 550 | — | — |
| " | 47 | 1050 | 25 | 710 | 1.10 | — | 700 | — |
| " | 48 | 1050 | 25 | 710 | 1.10 | — | — | 1050 |
| " | 49 | 1050 | 25 | 720 | 0.80 | — | 850 | — |

| | No. | Thickness (mm) | Cavity Defect Size (μ) | Ferrite Grain No. | Magnetic Flux Density at 80A/m (Tesla) | Variation of Magnetic Flux Density through Thickness Direction (%)* |
|---|---|---|---|---|---|---|
| Present Invention | 31 | 100 | 20 | 2 | 1.34 | ≦1 |
| " | 32 | 100 | 25 | 2 | 1.65 | ≦1 |
| " | 33 | 100 | 25 | 2 | 1.57 | ≦1 |
| " | 34 | 100 | 20 | 2 | 1.63 | ≦1 |
| " | 35 | 100 | 25 | 2 | 1.54 | ≦1 |
| " | 36 | 500 | 90 | 1 | 1.34 | ≦1 |
| " | 37 | 500 | 90 | 1 | 1.39 | ≦1 |
| " | 38 | 500 | 90 | 1 | 1.36 | ≦1 |
| " | 39 | 40 | 10 | 2 | 1.44 | ≦1 |
| " | 40 | 6 | 5 | 2 | 1.39 | ≦1 |
| Comparative | 41 | 150 | 70 | 7 | 1.10 | 12 |
| " | 42 | 150 | 200 | 3 | 0.64 | 17 |
| " | 43 | 150 | 80 | 3 | 0.56 | 4 |
| " | 44 | 150 | 85 | 3 | 1.11 | 15 |
| " | 45 | 150 | 150 | 4 | 0.86 | 10 |
| " | 46 | 150 | 70 | 2 | 0.90 | 12 |
| " | 47 | 10 | 10 | 2 | 0.85 | 14 |
| " | 48 | 10 | 10 | 2 | 0.87 | 9 |
| " | 49 | 100 | 50 | 2 | 0.88 | 15 |

*show the variations of the value measured at 5 mm under surface. ¼ thickness. ½ thickness.

We claim:

1. A method of producing non-oriented electrical steel plate having high magnetic flux density comprising the steps of:

preparing a steel slab comprising, by weight, up to 0.01 percent carbon, 0.10 to 3.5 percent silicon, up to 0.20 percent manganese, up to 0.01 percent sulfur, up to 0.05 percent chromium, up to 0.01 percent molybdenum, up to 0.01 percent copper, 0.10 to 3.0 percent aluminium, up to 0.004 percent nitrogen, up to 0.005 percent oxygen and up to 0.0002 percent hydrogen, with the remainder being substantially iron;

reheating the slab to a temperature of 1150° to 1300° C.;

hot-rolling the slab at least once at a rolling shape factor A of at least 0.6 at a finish rolling temperature of at least 900° C. to provide a steel plate having a plate thickness of 50 mm or more;

dehydrogenation heat treating the steel plate at between 600° and 750° C.;

whereby a magnetic flux density of 0.8 tesla or more at a magnetic field of 80 A/m is imparted to the steel;

wherein the hot rolling is accomplished using a rolling mill having a radius R(mm) and wherein the steel plate has an entry-side thickness $h_i$(mm) and an exit-side plate thickness $h_o$(mm) which exhibits a relationship with the rolling shape factor A of the hot rolling as follows:

$$A = (2\sqrt{R(h_i - h_o)})/(h_i + h_o).$$

2. The method according to claim 1 which further includes the step of annealing said dehydrogenation heat treated steel plate at a temperature of 750° to 950° C.

3. The method according to claim 1 which further includes the step of normalizing said dehydrogenation heat treated steel plate at a temperature of 910° to 1000° C.

4. A method of producing non-oriented electrical steel plate having high magnetic flux density comprising the steps of:

preparing a steel slab comprising, by weight, up to 0.01 percent carbon, 0.10 to 3.5 percent silicon, up to 0.20 percent manganese, up to 0.010 percent sulfur, up to 0.05 percent chromium, up to 0.01 percent molybdenum, up to 0.01 percent copper, 0.10 to 3.0 percent aluminium, up to 0.004 percent nitrogen, up to 0.005 percent oxygen and up to 0.0002 percent hydrogen, with the remainder being substantially iron;

reheating the slab to a temperature of 950° to 1150° C.;

hot-rolling the slab at least once at a rolling shape factor A of at least 0.6 at a finish rolling temperature of at least 800° C. to provide a steel plate having a plate thickness of 50 mm or more;

dehydrogenation heat treating the steel plate at between 600° and 750° C.;

whereby a magnetic flux density of 0.8 tesla or more at a magnetic field of 80 &l A/m is imparted to the steel;

wherein the hot rolling is accomplished using a rolling mill having a radius R(MM) and wherein the steel plate has an entry-side thickness $h_i$(mm) and wherein the steel plate thickness $h_o$(mm) which exhibits a relationship with the rolling shape factor A of the hot rolling as follows:

$$A = (2\sqrt{R(h_i - h_o)})/(h_i + h_o).$$

5. The method according to claim 4 which further includes the step of annealing said dehydrogenation heat treated steel plate at a temperature of 750° to 950° C.

6. The method according to claim 4 which further includes the step of normalizing said dehydrogentation heat treated steel plate at 910° to 1000° C.

7. A method of producing non-oriented electrical steel plate having high magnetic flux density comprising the steps of:

preparing a steel slab comprising, by weight, up to 0.01 percent carbon, 0.10 to 3.5 percent silicon, up to 0.20 percent manganese, up to 0.01 percent sulfur, up to 0.05 percent chromium, up to 0.01 percent molybdenum, up to 0.01 percent cooper, 0.10 to 3.0 percent aluminium, up to 0.004 percent nitrogen, up to 0.005 percent oxygen and up to 0.0002 percent hydrogen, with the remainder being substantially iron;

reheating the slab to a temperature of 1150° to 1300° C.

hot-rolling the slab at least once at a rolling shape factor A of at least 0.6 at a finish rolling temperature of at least 900° C. top provide a steel plate having a plate thickness of less than 50 mm;

annealing the hot rolled plate at a temperature of 750° C. to 950° C.;

whereby a magnetic flux density of 0.8 tesla or more at a magnetic field of 80 A/m is imparted to the steel;

wherein the hot rolling is accomplished using a rolling mill having a radius R(mm) and wherein the steel plate has an entry-side thickness $h_i$(mm) and an exit-side plate thickness $h_o$(mm) which exhibits a relationship with the rolling shape factor A of the hot rolling as follows:

$$A = (2\sqrt{R(h_i - h_o)})/(h_i + h_o).$$

8. A method of producing non-oriented electrical steel plate having high magnetic flux density comprising the steps of:

preparing a steel slab comprising, by weight, up to 0.01 percent carbon, 0.10 to 3.5 percent silicon, up to 0.20 percent manganese, up to 0.01 percent sulfur, up to 0.05 percent chromium, up to 0.01 percent molybdenum, up to 0.01 percent cooper, 0.10 to 3.0 percent aluminium, up to 0.004 percent nitrogen, up to 0.005 percent oxygen and up to 0.0002 percent hydrogen, with the remainder being substantially iron;

reheating the slab to a temperature of 1150° to 1300° C.;

hot rolling the slab at least once at a rolling shape factor A of at least 0.6 at a finish rolling temperature of at least 900° C. to provide a steel plate having a plate thickness of less than 50 mm;

normalizing the hot rolled plate at a temperature of 910° C. to 1000° C.;

whereby a magnetic flux density of 0.8 tesla or more at a magnetic field of 80 A/m is imparted to the steel;

wherein the hot rolling is accomplished using a rolling mill having a radius R(mm) and wherein the steel plate has an entry-side thickness $h_i$(mm) and an exit-side plate thickness $h_o$(mm) which exhibits a relationship with the rolling shape factor A of the hot rolling as follows:

9. A method of producing non-oriented electrical steel plate having high magnetic flux density comprising the steps of:

preparing a steel slab comprising, by weight, up to 0.01 percent carbon, 0.10 to 3.5 percent silicon, up to 0.20 percent manganese, up to 0.001 percent sulfur, up to 0.05 percent chromium, up to 0.01 percent molybdenum, up to 0.01 percent cooper, 0.10 to 3.0 percent aluminium, up to 0.004 percent nitrogen, up to 0.005 percent oxygen and up to 0.0002 percent hydrogen, with the remainder being substantially iron;

reheating the slab to a temperature of 950° to 1150° C.;

hot-rolling the slab at least once at a rolling shape factor A of at least 0.6 at a finish rolling temperature of at least 800° C. to provide a steel plate having a plate thickness of less than 50 mm;

annealing the hot rolled plate at a temperature of 750° C. to 950° C.;

whereby a magnetic flux density of 0.8 tesla or more at a magnetic field of 80 A/m is imparted to the steel;

wherein the hot rolling is accomplished using a rolling mill having a radius R(mm) and wherein the steel plate has an entry side thickness $h_i$(mm) and an exit-side plate thickness $h_o$(mm) which exhibits a relationship with the rolling shape factor A of the hot rolling as follows:

$$A = (2\sqrt{R(h_i - h_o)})/(h_i + h_o).$$

10. A method of producing non-oriented electrical steel plate having high magnetic flux density comprising the steps of:

preparing a steel slab comprising, by weight, up to 0.01 percent carbon, 0.10 to 3.5 percent silicon, up to 0.20 percent manganese, up to 0.001 percent sulfur, up to 0.05 percent chromium, up to 0.01 percent molybdenum, up to 0.01 percent cooper, 0.10 to 3.0 percent aluminium, up to 0.004 percent nitrogen, up to 0.005 percent oxygen and up to 0.0002 percent hydrogen, with the remainder being substantially iron;

reheating the slab to a temperature of 950° to 1150° C.;

hot-rolling the slab at least once at a rolling shape factor A of at least 0.6 at a finish rolling temperature of at least 800° C. to provide a steel plate having a plate thickness of less than 50 mm;

whereby a magnetic flux density of 0.8 tesla or more at a magnetic field of 80 A/m is imparted to the steel;

wherein the hot rolling is accomplished using a rolling mill having a radius R(mm) and wherein the steel plate has an entry side thickness $h_i$(mm) and an exit-side plate thickness $h_o$(mm) which exhibits a relationship with the rolling shape factor A of the hot rolling as follows:

$$A = (2\sqrt{R(h_i - h_o)})/(h_i + h_o).$$

* * * * *

UNITED STATES PATENT AND TRADEMARK OFFICE

CERTIFICATE OF CORRECTION

PATENT NO. : 5,062,905

DATED : November 5, 1991

INVENTOR(S) : Yukio TOMITA, et al.

It is certified that error appears in the above-identified patent and that said Letters Patent is hereby corrected as shown below:

Column 2, line 65, change "facto" to --factor--.

Column 6, lines 17 and 28, change "conductive" to --conducive--.

Column 6, line 36, between "percent" and "up" insert --at--.

Column 8, line 6, change "steel b 25" to --steel 25--.

Column 10, Table 2, first line under column A1, change "2.0" to --2.1--.

Column 13, line 26, delete "&1"

Column 13, line 29, change "R(MM)" to --R(mm)--.

Column 13, line 31, delete "wherein the steel" and insert --an exit-side--.

Column 14, line 40, after "follows:" insert $A=(2\sqrt{R(h_1-h_o)})/(h_i+h_o)$. --

UNITED STATES PATENT AND TRADEMARK OFFICE

CERTIFICATE OF CORRECTION

PATENT NO. : 5,062,905

DATED : November 5, 1991

INVENTOR(S) : Yukio TOMITA, et al.

It is certified that error appears in the above-identified patent and that said Letters Patent is hereby corrected as shown below:

Column 14, line 46, change "0.001" to --0.010--.

Column 14, line 48, change "cooper." to --copper.--

Column 15, line 13, change "0.001" to --0.010--.

Column 15, line 15, change "cooper." to --copper.--.

Col. 16, line 6, after "50mm" insert paragraph to read

--normalizing said hot rolled plate at a temperature of 910 C to 1000 C;--

Signed and Sealed this

Twenty-fourth Day of August, 1993

Bruce Lehman

*Attest:*

BRUCE LEHMAN

*Attesting Officer*

*Commissioner of Patents and Trademarks*